US006512327B1

(12) United States Patent
Yoon et al.

(10) Patent No.: US 6,512,327 B1
(45) Date of Patent: Jan. 28, 2003

(54) SOLUTION FOR MAKING A RESIN FILM AND ITS APPLICATION AT SCREENS OF CRTS

(75) Inventors: Sang Youl Yoon, Kyungsangbuk-do (KR); Dong Ky Shin, Kyungsangbuk-do (KR); Hyo Sup Lee, Kyungsangbuk-di (KR)

(73) Assignee: Orion Electric Co., Ltd., Kyungsanbuk-Do (KR)

( * ) Notice: Subject to any disclaimer, the term of this patent is extended or adjusted under 35 U.S.C. 154(b) by 0 days.

(21) Appl. No.: 09/486,305

(22) PCT Filed: Dec. 31, 1997

(86) PCT No.: PCT/KR97/00286

§ 371 (c)(1),
(2), (4) Date: May 8, 2000

(87) PCT Pub. No.: WO99/12179

PCT Pub. Date: Mar. 11, 1999

(30) Foreign Application Priority Data

Aug. 3, 1997 (KR) ..... 97-43632

(51) Int. Cl.[7] ..... H01J 29/10

(52) U.S. Cl. ..... 313/461; 313/473; 313/466

(58) Field of Search ..... 313/461, 463, 313/466, 473

*Primary Examiner*—Vip Patel

(74) *Attorney, Agent, or Firm*—Notaro & Michalos P.C.

(57) ABSTRACT

An improved resin layer used in the manufacture of cathode ray tube assemblies incorporates inorganic particles in the resin. The resin layer with particles is coated on a CRT screen prior to coating with aluminum film. The resin layer is volatilizable, so that following applying the aluminum film, the screen is baked to drive off the resin. The inorganic particles in the resin layer create an uneven boundary with the screen, so that during baking, volatilized resin in the form of gases can escape from between the aluminum and screen without forming bubbles or causing swelling.

14 Claims, 3 Drawing Sheets

34
32
18

36
34
38
18

35
35'
16a
16
34
32
18

18
32
34
35''

21
34
32
18

SOLUTION FOR MAKING A RESIN FILM AND ITS APPLICATION AT SCREENS OF CRTS

FIELD OF THE INVENTION

The present invention relates to a solution for making a resin film, a method for manufacturing a screen of a CRT using the solution and a CRT manufactured by the method, and more particularly to a solution for making a resin film, by which an aluminum thin film having an improved effective plane of reflection can be formed.

DESCRIPTION OF THE PRIOR ART

A known CRT screen and method of making a CRT screen will now be described with reference to FIGS. 1–3E, which illustrate the prior art.

Referring to FIG. 1, a color CRT 10 generally comprises an evacuated glass envelope consisting of a panel 12, a funnel 13 sealed to the panel 12 and a tubular neck 14 connected by the funnel 13, an electron gun 11 centrally mounted within the neck 14, and a shadow mask 16 removably mounted to an inner sidewall of the panel 12. A three color phosphor screen is formed on the inner surface of a display window or faceplate 18 of the panel 12.

The electron gun 11 generates three elect-on beams 19*a* or 19*b*, said beams being directed along convergent paths through the shadow mask 16 to the screen 20 by means of several lenses of the gun and a high positive voltage applied through an anode button 15 and being deflected by a deflection yoke 17 so as to scan over the screen 20 through apertures or slits 16*a* formed in the shadow mask 16.

In the color CRT 10, the phosphor screen 20, which is formed on the inner surface of the faceplate 18, comprises an array of three phosphor elements R, G and B of three different emission colors arranged in a cyclic order of a predetermined structure of multiple-stripe or multiple-dot shape and a matrix of light-absorptive material 21 surrounding the phosphor elements R, G and B, as shown in FIG. 2.

A thin film of aluminum 22 or electro-conductive layer, overlying the screen 20 in order to provide a means for applying the uniform potential applied through the anode button 15 to the screen 20, increases the brightness of the phosphor screen, prevents ions from the phosphor screen and prevents the potential of the phosphor screen from decreasing. And also, a resin film 22' such as lacquer is applied to the phosphor screen 20 before forming the aluminum thin film 22, so as to enhance the flatness and reflectivity of the aluminum thin film 22. The resin film 22' must be burned to volatilize after the aluminum thin film 22 is formed, so as to improve the life of the tube.

In a photolithographic wet process, which is well known as a prior art process for forming the phosphor screen, a slurry of a photosensitive binder and phosphor particles is coated on the inner surface of the faceplate. It does not meet the higher resolution demands and requires a lot of complicated processing steps and a lot of manufacturing equipments with the use of a large quantity of clean water, thereby necessitating high cost in manufacturing the phosphor screen. In addition, it discharges a large quantity of effluent such as waste water, phosphor elements, 6th chrome sensitizer, etc.

To solve or alleviate the above problems, an improved process of electro-photographically manufacturing the screen utilizing dry-powdered phosphor particles is developed.

U.S. Pat. No. 4,921,767, issued to Datta at al. on May 1, 1990, discloses the improved method of electro-photographically manufacturing the phosphor screen assembly using dry-powdered phosphor particles through a series of steps represented in FIGS. 3A to 3E, as is briefly explained in the following.

After the panel 12 is washed, an electro-conductive layer 32 is coated on the inner surface of the faceplate 18 of the panel 12 and the photo-conductive layer 34 is coated thereon, as shown in FIG. 3A. Conventionally, the electro-conductive layer 32 is made from an inorganic conductive material such as tin oxide or indium oxide, or their mixture, and preferably, from a volatilizable organic conductive material such as a polyelectrolyte commercially known as polybrene (1,5-dimethyl-1,5-diaza-undecamethylene polymethobromide, hexadimethrine bromide), available from Aldrich Chemical Co.

The polybrene is applied to the inner surface of the faceplate 18 in an aqueous solution containing about 10 percent by weight of propanol and about 10 percent by weight of a water-soluble adhesion-promoting polymer (poly vinyl alcohol, polyacrylic acid, polyamide and the like), and the coated solution is dried to form the conductive layer 32 having a thickness from about 1 to 2 microns and a surface resistivity of less than about $10^8$ Ω/□ (ohms per square unit).

The photo-conductive layer 34 is formed by coating the conductive layer 32 with a photo-conductive solution comprising a volatilizable organic polymeric material, a suitable photo-conductive dye and a solvent. The polymeric material is an organic polymer such as polyvinyl carbazole, or an organic monomer such as n-ethyl carbazole, n-vinyl carbazole or tetraphenylbutatriene dissolved in a polymeric binder such as polymethylmethacrylate or polypropylene carbonate. The photo-conductive composition contains from about 0.1 to 0.4 percent by weight such dyes as crystal violet, chloridine blue, rhodamine EG and the like, which are sensitive to the visible rays, preferably rays having wavelength of from about 400 to 700 nm. The solvent for the photo-conductive composition is an organic material such as chlorobenzene or cyclopentanone and the like which will produce as little contamination as possible on the conductive layer 32. The photo-conductive layer 32 is formed to have a thickness from about 2 to 6 microns.

FIG. 3B schematically illustrates a charging step, wherein the photo-conductive layer 34 overlying the electro-conductive layer 32 is positively charged in a dark environment by a conventional positive corona discharger 36. As shown, the charger or charging electrode of the discharger 36 is positively applied with direct current while the negative electrode of the discharger 36 is connected to the electro-conductive layer 32 and grounded. The charging electrode of the discharger 36 travels across the layer 34 and charges it with a positive voltage in the range from +200 to +700 volt.

FIG. 3C schematically shows an exposure step, wherein the charged photo-conductive layer 34 is exposed through a shadow mask 16 by a xenon flash lamp 35 having a lens system 35' in the dark environment. In this step, the shadow mask 16 is installed on the panel 12 and the electro-conductive layer 32 is grounded. When the xenon flash lamp 35 is switched on to shed light on the charged photo-conductive layer 34 through the lens system 35' and the shadow mask 16, portions of the photo-conductive layer 34 corresponding to apertures or slits 16 a of the shadow mask 16 are exposed to the light. Then, the positive charges of the exposed areas are discharged through the grounded conductive layer 32 and the charges of the unexposed areas remain in the photo-conductive layer 34, thus establishing a latent charge image in a predetermined array structure, as shown in FIG. 3C. In order to exactly attach light-absorptive materials, it is preferred that the xenon flash lamp 35 travels along three positions while coinciding with three different incident angles of the three electron beams.

FIG. 3D schematically shows a developing step which utilizes a developing container 35" containing dry-powdered light-absorptive or phosphor particles and carrier beads for producing static electricity by coming into contact with the dry-powdered particles. Preferably, the carrier beads are so mixed as to charge the light-absorptive particles with negative electric charges and the phosphor powders with positive electric charges when they come into contact with the dry-powdered particles.

In this step, the panel 12, from which the shadow mask 16 is removed, is put on the developing container 35" containing the dry-powdered particles, so that the photo-conductive layer 34 can come into contact with the dry-powdered particles. In this case, the negatively charged light-absorptive particles are attached to the positively charged unexposed areas of the photo-conductive layer 34 by electric attraction, while the positively charged phosphor particles are repulsed by the positively charged unexposed areas but attached by reversal developing to the exposed areas of the photo-conductive layer 34 from which the positive electric charges are discharged.

FIG. 3E schematically represents a fixing step by means of infrared radiation. In this step, the light-absorptive and phosphor particles attached in the above developing step are fixed together and onto the photo-conductive layer 34. Therefore, the dry-powdered particles includes proper polymer components which may be melted by heat and have proper adhesion.

The steps of charging, exposing, developing and fixing are repeated for the three different phosphor particles. Moreover, the same process of the above steps can be repeated also for the black matrix particles before or after the three different phosphor particles are formed.

After the three different phosphor particles and the black matrix particles are formed through the above process, a lacquer film is formed through a lacquering step and an aluminum thin film is formed through an aluminizing step respectively by a conventional method. Thereafter, the faceplate panel 12 is baked in air at a temperature of 425° C., for about 30 minutes to drive off the volatilizable constituents such as the organic solvents from the conductive layer 32, the photo-conductive layer 34, the phosphor elements and the lacquer film, thereby forming a screen array 20 of light-absorptive material 21 and three phosphor elements R, G and B in FIG. 2.

The conventional method of electro-photographically manufacturing the phosphor screen assembly using dry-powdered phosphor particles as described above has one problem that it requires dark environment during all the steps until the fixing step after the photo-conductive layer is formed, because the photo-conductive layer is sensitive to the visual light. Also, the fixing step of FIG. 3E is still necessary even after the developing step.

To overcome this problem, the applicant proposed a method of forming the photo-conductive layer using a photo-conductive solution responsive to the ultraviolet rays. The solution for the photo-conductive layer 34 responsive to the ultraviolet rays, for example, may contain: an electron donor material, such as about 0.01 to 1 percent by weight of bis-1,4-dimethyl phenyl (-1,4-diphenyl (butatriene)) or 2 to 5 percent by weight of tetraphenyl ethylene (TPE); an electron acceptor material, such as about 0.01 to 1 percent by weight of at least one of trinitro-fluorenone (TNF) and ethyl anthraquinone (EAQ); a polymeric binder, such as 1 to 30 percent by weight polystyrene; and a solvent such as the remaining percent by weight of toluene or xylene.

As the polymeric binder, poly(α-methylstyrene) (PαMS), polymethylmethacrylate (PMMA), and polystyrene-oxazoline copolymer (PS-OX) may be employed instead of the polystyrene.

However, in the fixing step of FIG. 3E for fixing the phosphor particles, the developed phosphor particles P come down into the photo-conductive layer 34 as shown in FIGS. 4A and 4B. After that, when the resin film 22' has been formed, the surface of the resin film 22' becomes smooth as the inner surface of the panel 12. Then, gas generated from the conductive layer 32, the photo-conductive layer 34 and the resin film 22' during the burning step in a frit furnace for sealed-assembling the panel and the funnel or during the baking step applies an over-pressure to the aluminum thin film 22, so that the aluminum thin film 22 becomes swollen and unfastened upward from the screen easily. In result, the plane reflectivity of the aluminum thin film 22 is deteriorated, and moreover the volatile resin remains therein to deteriorate the picture quality.

SUMMARY OF THE INVENTION

The present invention has been made to overcome the above described problems, and therefore it is an object of the present invention to provide a solution for making a resin film, a method for manufacturing a screen of a CRT using the solution and a CRT manufactured by the method, in which a resin film in a wet slurry method, or a conductive layer, a photo-conductive layer and a resin film in the dry-electrophotographically manufacturing method can be completely volatilized without the upward swelling and unfastening of the aluminum thin film.

To achieve the above objects, the present invention provides a solution for making a resin film in a cathode ray tube, the cathode ray tube having a phosphor screen formed on an inner surface of a faceplate, the phosphor screen comprising:

an array of three phosphor elements R, G and B of three different emission colors arranged in a cyclic order of a predetermined structure of multiple-stripe or multiple-dot shape and a matrix of light-absorptive material surrounding the phosphor elements R, G and B;

a resin film such as a lacquer film formed on the light-absorptive material and the phosphor elements; and an aluminum thin film formed on the resin film just after the resin film is formed, the resin film enhancing a flatness and a reflectivity of the aluminum thin film, the aluminum thin film functioning as a conductive film and a plane of reflection;

wherein the solution comprises inorganic particles.

The resin film, which is formed with the solution, comprises a harsh and rugged surface due to the inorganic particles. Therefore, the aluminum film can be strongly attach to the resin film, and the gas generated from the conductive layer, the photo-conductive layer and the resin film during the burning step in a frit furnace for sealed-assembling the panel and the funnel is dispersed and discharged through the harsh and rugged surface over the entire area of the resin film, to thereby apply a decreased pressure to the aluminum thin film. Accordingly, the conductive layer, the photo-conductive layer and the resin film can be completely volatilized without the upward swelling and unfastening of the aluminum thin film and the refletivity of the aluminum film can be improved.

The present invention further provides a cathode ray tube having a phosphor screen formed on an inner surface of a faceplate, the phosphor screen comprising:

an array of three phosphor elements R, G and B of three different emission colors arranged in a cyclic order of a predetermined structure of multiple-stripe or multiple-dot shape and a matrix of light-absorptive material surrounding the phosphor elements R, G and B;

a resin film such as a lacquer film formed on the light-absorptive material and the phosphor elements, the resin film being applied by a solution containing inorganic particles, said inorganic particles remaining after the resin film is volatilized by heat; and an aluminum thin film formed on the resin film after the resin film is formed, the resin film enhancing a flatness and a reflectivity of the aluminum thin film.

In addition, the present invention provides a method for electro-photographically manufacturing a screen of a CRT utilizing dry-powdered phosphor particles, the method comprising the steps of:

forming a volatile conductive layer on an inner surface of a panel by utilizing at least one of the phosphor elements and the light-absorptive material;

forming a volatile photo-conductive layer on the volatile conductive layer, the volatile photo-conductive layer containing a material responsive to visible rays or ultraviolet rays;

charging the volatile photo-conductive layer with uniform electrostatic charges;

exposing the volatile photo-conductive layer through a shadow mask to a light source so as to selectively discharge the electrostatic charges from the volatile photo-conductive layer;

developing the photo-conductive layer by charging powdered particles to be attached on one of an exposed area and an unexposed area of the photo-conductive layer;

forming a resin film on the light-absorptive material and the phosphor elements with a resin solution such as lacquer containing inorganic substance;

forming an aluminum thin film on the resin film, the aluminum thin film functioning as a conductive film and a plane of reflection; and driving off volatilizable constituents from the conductive layer, the photo-conductive layer, and the resin film by heat.

Preferably, the inorganic particles are 0.01 to 50% by weight of solid substance of the resin film, and the inorganic particles may be $SiO_2$, which has no color or a white color, thereby exerting no bad effect on the quality of the screen even if the inorganic particles remain on the screen. And, it is preferred that the inorganic particles respectively have a diameter equal to or smaller than 0.5 $\mu$m.

BRIEF DESCRIPTION OF THE DRAWINGS

The above object, and other features and advantages of the present invention will become more apparent by describing in detail preferred embodiments thereof with reference to the attached drawings, in which.

DETAILED DESCRIPTION OF THE PREFERRED EMBODIMENTS

Hereinafter, a preferred embodiment of the present invention will be described in detail with reference to the attached drawings.

When a screen of a color CRT is manufactured, a resin film 22' such as lacquer is formed between an aluminum thin film 22 and a light-absorptive material 21 together with the phosphor particles R, G and B, so as to enhance the flatness and reflectivity of the aluminum thin film 22, just before the aluminum thin film 22 is formed. The resin film 22' is burned to volatilize in a frit furnace for sealed-assembling the panel and the funnel with each other, so as to eliminate the possibility of generation of gas after the aluminum thin film 22 is formed, to thereby improve the life of the CRT.

Figure 5:
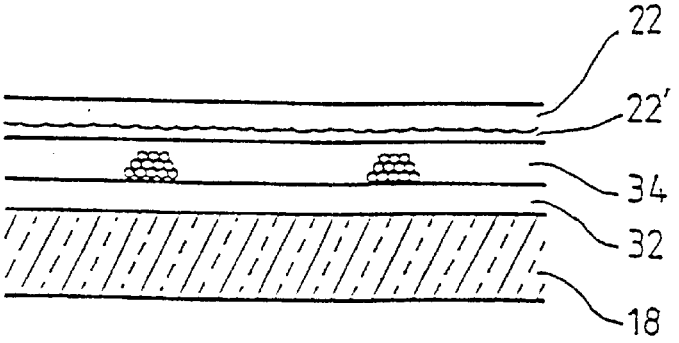
FIG. 5 is a schematic diagram illustrating the process of the invention for forming a resin film during manufacture of a screen assembly for the cathode ray tube of FIG. 1 to overcome the problems of the prior art process.

According to the present invention, the surface of the resin film 22' is formed uneven as shown in FIG. 5 to enhance the adhesion of the aluminum thin film 22. Also, the gas generated from the conductive layer 32, the photo-conductive layer 34 and the resin film 22' during the burning step in a frit furnace for sealed-assembling the panel and the funnel is dispersed and discharged along the gaps between the regional uneven portions over the entire area, to thereby apply a decreased pressure to the aluminum thin film 22. Therefore, the conductive layer 32, the photo-conductive layer 34, and the resin film 22' can be completely volatilized without the upward swelling and unfastening of the aluminum thin film 22.

As an example, the solution for making a resin film of a CRT according to the present invention includes a lacquer solution containing silicon dioxide $SiO_2$ as inorganic particles of diameters equal to or smaller than 0.5 $\mu$m, the quantity of which is 0.01 to 50% by weight of the solid substance of the resin film 22'.

After forming a predetermined array of the light-absorptive material 21 and three phosphor elements R, G and B by the method of dry-electrophotographically manufacturing the phosphor screen assembly through a series of steps represented in FIGS. 3A to 3E, the resin film 22' is formed on the inner surface of the light-absorptive material 21 and the three phosphor elements R, G and B with lacquer containing inorganic particles utilizing the above solution for making a resin film of a CRT. Thereafter, an aluminum thin film 22 which functions as a conductive film and a plane of reflection is formed on the resin film 22', and then subjected to a baking step in order to volatilize the volatile ingredient by heat from the conductive layer 32, the photo-conductive layer 34, and the resin film 22'. The resultants according to the changes of the remaining quantities of the inorganic particles are as follows.

| quantity of $SiO_2$ (wt %) among inorganic solid material of the resin film 22' | number of swollen aluminum thin film 22 (number of swollen film/number of test piece) |
|---|---|
| 0.00% | 7/10 |
| 0.01% | 2/10 |
| 1.00% | 0/10 |
| 10.00% | 0/10 |
| 50.00% | 0/10 |

As apparent from the above table, although 1 to 10% by weight based on the solid substance is most proper for the quantity of the $SiO_2$ to be used, only 0.01% by weight can have a good effect.

The above method for electro-photographically manufacturing a screen of a CRT utilizing dry-powdered phosphor particles, comprises the steps of: (1) forming a volatile conductive layer on an inner surface of a panel with a conventional organic conductive solution; (2) forming a volatile photo-conductive layer on the volatile conductive layer with the photo-conductive solution of the present invention; (3) charging the volatile photo-conductive layer with uniform electrostatic charges; (4) exposing the volatile photo-conductive layer through a shadow mask to a light source so as to selectively discharge the electrostatic charges from the volatile photo-conductive layer; and (5) developing the photo-conductive layer by charging powdered particles to be attached on one of an exposed area and an unexposed area of the photo-conductive layer.

In case of a color CRT, the above steps are repeated for the three different phosphor particles. Moreover, the same process of the above steps can be repeated also for the light-absorptive material or black matrix particles 21 before or after the three different phosphor particles are formed. In this case, the employed panel 12 may have an array of a predetermined pattern of the black matrix particles 21 by a conventional wet slurry method.

Figure 1:
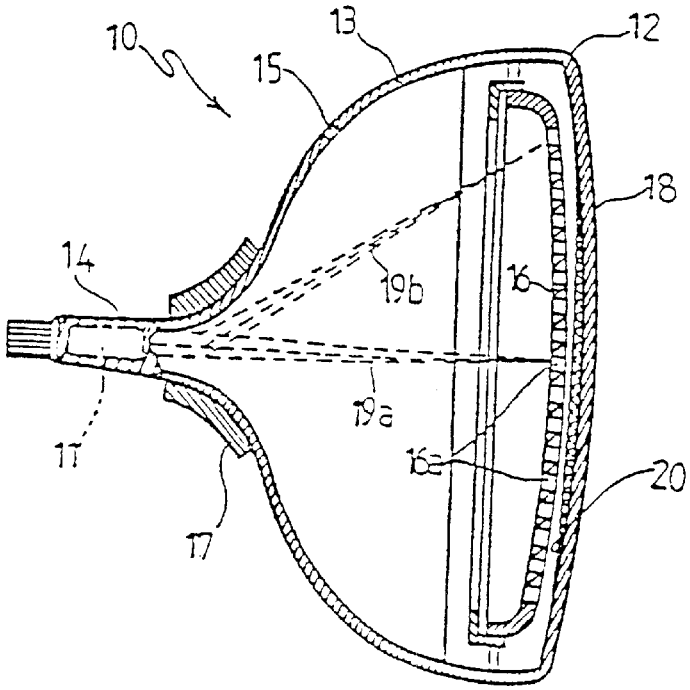
FIG.1 (PRIOR ART)
FIG. 1 is a partial sectional plan view of illustrating the construction of a prior art color cathode ray tube.
Figure 2:
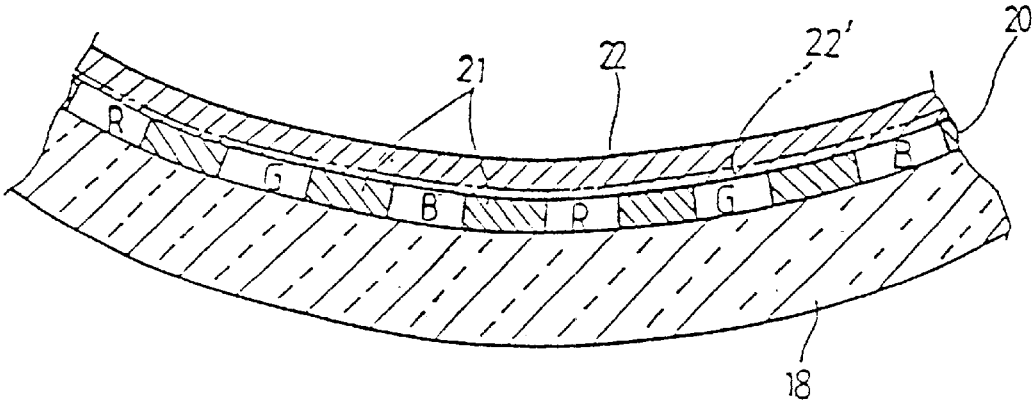
FIG.2 (PRIOR ART)
FIG. 2 is an enlarged partial sectional plan view-of a screen assembly of the prior art tube of FIG. 1.

After the three different phosphor particles and the black matrix particles are formed through the above process, a lacquer film or resin film 22' is formed by a resin-film-applying solution containing silicon dioxide $SiO_2$ particles as inorganic particles according to the present invention in a lacquering step. Then, an aluminum thin film is formed through an aluminizing step by a conventional method. Thereafter, the faceplate panel 12 is baked in air at a temperature of 425° C., for about 30 minutes to drive off the volatilizable constituents such as the organic solvents from the conductive layer 32, the photo-conductive layer 34, the phosphor elements and the lacquer film, thereby forming a screen array of light-absorptive material 21 and three phosphor elements R, G and B as shown in FIG. 2.

Figure 4A:
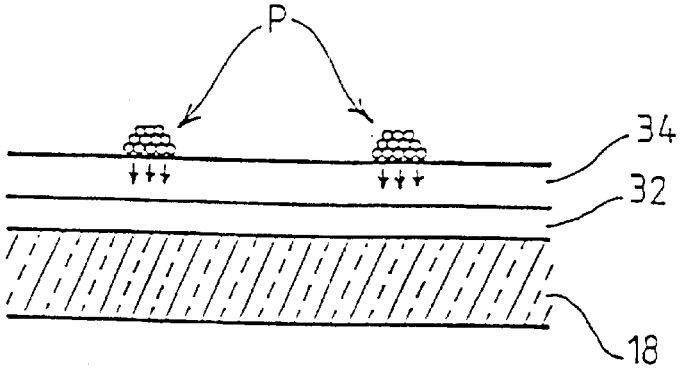
FIG.4A (PRIOR ART)
FIGS. 4A & 4B are schematic diagrams illustrating the problems associated with the prior art method diagramed in FIGS. 3A–3E.
Figure 4B:
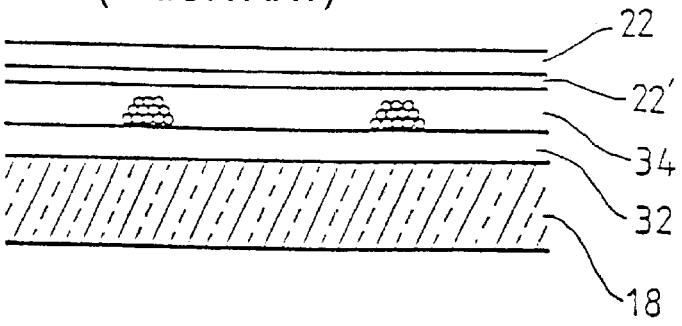
FIG.4B (PRIOR ART)

In the meantime, though detailed description is omitted, the same effect as above is obtained by not only the above dry method for electro-photographically manufacturing a screen of a CRT but also another process in which the resin film 22' containing the inorganic material according to the present invention is formed after the phosphor elements and the light-absorptive material are formed by the wet slurry method. However, the lacquer containing $SiO_2$ is more proper for the dry method of electro-photographically manufacturing a screen of a CRT as shown in FIGS. 4A and 4B because the flatness of the surface of the resin film is greater in case of the dry method of electro-photographically manufacturing a screen of a CRT than in case of the wet slurry method.

In the CRT manufactured through the above process, silicon dioxide ($SiO_2$) particles remain on the phosphor screen 20. Further, the above effect is also achieved even when the resin film 22' is formed to contain other inorganic material. However, the silicon dioxide ($SiO_2$) employed in the present invention is more preferable in that, because it has no or white color and thus is transparent, it cause no deterioration of brightness and has no effect on the picture quality even in case it remains.

Figures 3A, 3B, 3C, 3D, 3E:
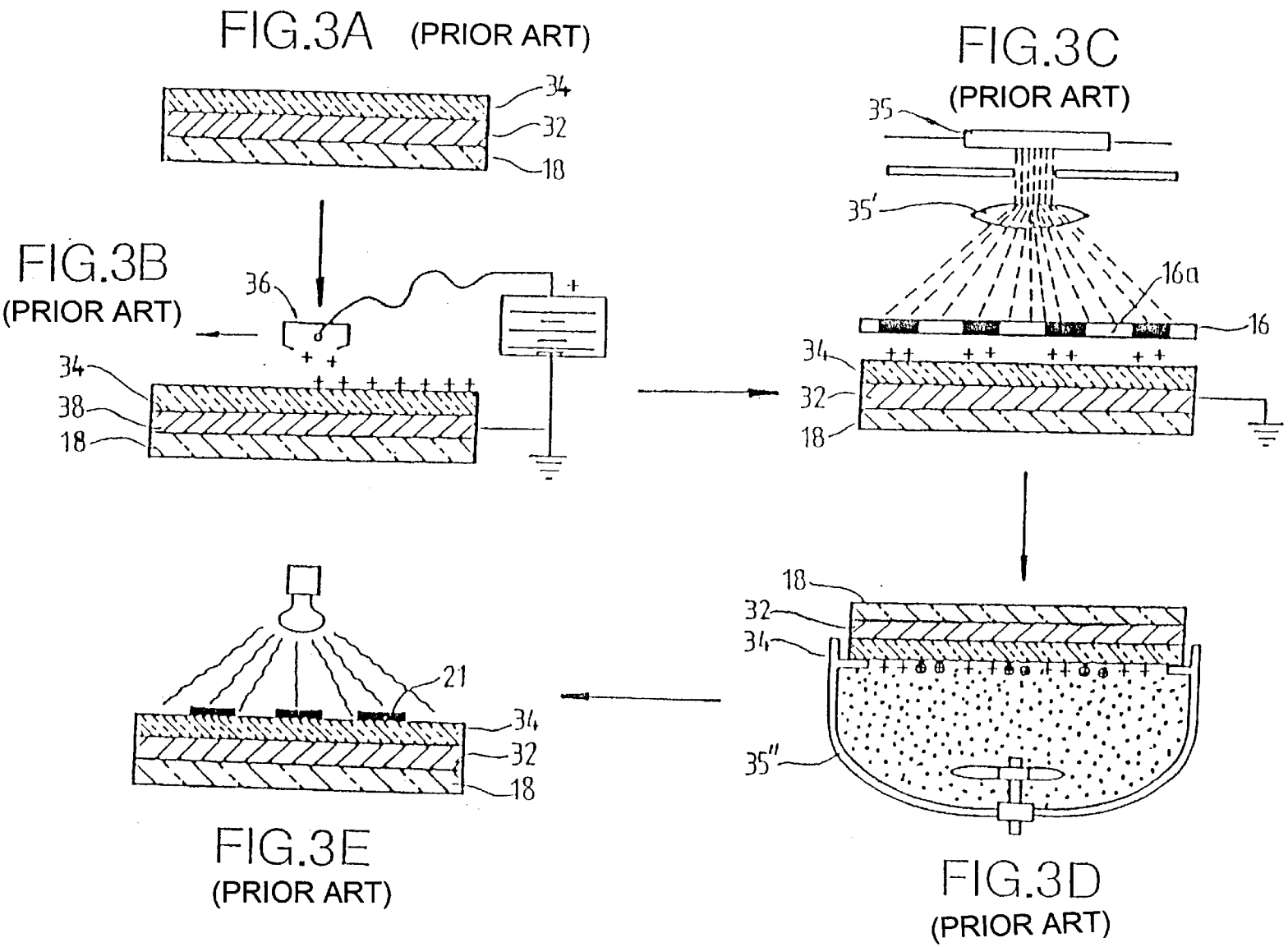
FIG.3A (PRIOR ART)
FIG.3B (PRIOR ART)
FIG.3C (PRIOR ART)
FIG.3D (PRIOR ART)
FIG.3E (PRIOR ART)
FIGS. 3A–3E are schematic sectional diagrams illustrating a prior art method of dry-electrophotographically manufacturing a screen assembly for the prior art tube of FIG. 1.

Moreover, in the developing step, instead of being charged by such contact as shown in FIG. 3D, the powdered particles may be charged by a contact with a pipe in the course of being supplied, or charged by a corona discharge just before being sprayed by a spray coater.

The fixing step as shown in FIG. 3E may employ a vapor swelling method wherein the fixing is performed by a contact with a solvent vapor such as acetone and methyl isobutyl ketone, or a spraying method wherein an electrostatic solution spray gun sprays a mixture of more than two kinds among methyl isobutyl ketone, TCE, toluene, and xylene of the petroleum group on the developed powdered-particles of red, green, and blue. Otherwise, the fixing step may be omitted partly or totally.

As apparent from the above description, by the construction and the function of the solution for making a resin film, the method for manufacturing a screen of a CRT using the solution and the CRT manufactured by the method according to the present invention, the adhesion of the aluminum thin film 22 is greatly improved, and as well the conductive layer 32, the photo-conductive layer 34, and the resin film 22' can be completely volatilized without the upward swelling and unfastening of the aluminum thin film 22 during the burning step in a frit furnace for sealed-assembling the panel and the funnel, so that the plane reflectivity of the aluminum thin film 22 is improved and thus the picture quality of the CRT is greatly improved.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A cathode ray tube having a phosphor screen formed on an inner surface of a faceplate, the phosphor screen comprising:

an array of three phosphor elements of three different emission colors arranged in a cyclic order of a predetermined structure of multiple-stripe or multiple-dot shape and a matrix of light-absorptive material surrounding the phosphor elements;

a resin film formed on the light-absorptive material and the phosphor elements, the resin film being applied by a solution containing inorganic particles, said inorganic particles remaining after the resin film is volatilized by heat;

an aluminum thin film formed on the resin film, the resin film enhancing a flatness and reflectivity of the aluminum thin film.

2. A cathode ray tube according to claim 1, wherein the inorganic particles in the solution comprise 0.01% to 50% by weight of solid substance of the resin film.

3. A cathode ray tube according to claim 1, wherein the inorganic particles are $SiO_2$.

4. A cathode ray tube according to claim 3, wherein the inorganic particles have a diameter equal to or less than 0.5 $\mu$m.

5. A cathode ray tube according to claim 1, wherein the inorganic particles have a diameter equal to or less than 0.5 μm.

6. A cathode ray tube according to claim 1, wherein the phosphor screen is manufactured by a process comprising:

forming a volatile conductive layer on an inner surface of a panel utilizing at least one of the phosphor elements and the light-absorptive material;

forming a volatile photo-conductive layer on the volatile conductive layer, the volatile photo-conductive layer containing a material responsive to visible rays or ultraviolet rays;

charging the volatile photo-conductive layer with uniform electrostatic charges;

exposing the volatile photo-conductive layer through a shadow mask to a light source so as to selectively discharge the electrostatic charges from the volatile photo-conductive layer; and developing the photo-conductive layer by charging powdered particles to be attached on one of an exposed area and an unexposed area of the photo-conductive layer.

7. A cathode ray tube having a phosphor screen assembly formed by a process comprising:

forming a volatile conductive layer on an inner surface of a panel utilizing at least one of the phosphor elements and the light-absorptive material;

forming a volatile photo-conductive layer on the volatile conductive layer, the volatile photo-conductive layer containing a material responsive to visible rays or ultraviolet rays;

charging the volatile photo-conductive layer with uniform electrostatic charges;

exposing the volatile photo-conductive layer through a shadow mask to a light source so as to selectively discharge the electrostatic charges from the volatile photo-conductive layer;

developing the photo-conductive layer by charging powdered particles to be attached on one of an exposed area and an unexposed area of the photo-conductive layer;

forming a resin film to the photo-conductive layer by coating the photo-conductive layer with a lacquer solution containing inorganic particles to create uneven portions in the resin film;

applying an aluminum thin film to the resin film after forming the resin film; and baking the phosphor screen to volatilize the resin film, whereby gases formed by volatilizing the resin film escape through the uneven portions to minimize bubbling and swelling of the aluminum thin film.

8. A cathode ray tube according to claim 7, wherein the inorganic particles comprise $SiO_2$.

9. A cathode ray tube according to claim 7, wherein the inorganic particles have diameters equal to or less than 0.5 μm.

10. A cathode ray tube according to claim 7, wherein the inorganic particles in the solution comprise 0.01% to 50% by weight of solid substance of the resin film.

11. A cathode ray tube having a screen formed by the process comprising:

forming an array on the screen of three phosphor elements of three different emission colors arranged in a cyclic order of a predetermined structure of multiple-stripe or multiple-dot shape and a matrix of light-absorptive material surrounding the phosphor elements;

forming a resin film to the photo-conductive layer by coating the photo-conductive layer with a lacquer solution containing inorganic particles to create uneven portions in the resin film;

applying an aluminum thin film to the resin film after forming the resin film; and baking the phosphor screen to volatilize the resin film, whereby gases formed by volatilizing the resin film escape through the uneven portions to minimize bubbling and swelling of the aluminum thin film.

12. A cathode ray tube according to claim 11, wherein the inorganic particles comprise $SiO_2$.

13. A cathode ray tube according to claim 11, wherein the inorganic particles have diameters equal to or less than 0.5 μm.

14. A cathode ray tube according to claim 11, wherein the inorganic particles in the solution comprise 0.01% to 50% by weight of solid substance of the resin film.

* * * * *